US008708741B2

(12) United States Patent
Tanaka et al.

(10) Patent No.: US 8,708,741 B2
(45) Date of Patent: Apr. 29, 2014

(54) ELECTRICAL CONNECTOR WITH THERMAL CONDUCTIVE SUBSTRATE

(75) Inventors: Tetsugaku Tanaka, Shinagawa (JP); Tohru Yamakami, Shinagawa (JP); Takeshi Okuyama, Shinagawa (JP); Toshihiro Kusagaya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/587,483

(22) Filed: Aug. 16, 2012

(65) Prior Publication Data

US 2013/0045634 A1 Feb. 21, 2013

(30) Foreign Application Priority Data

Aug. 19, 2011 (JP) ..... 2011-179528

(51) Int. Cl.
*H01R 9/03* (2006.01)

(52) U.S. Cl.
USPC ..... 439/607.05; 439/485

(58) Field of Classification Search
USPC ..... 439/626, 607.05, 607.06, 607.07, 439/607.08, 607.34, 485
See application file for complete search history.

(56) References Cited

U.S. PATENT DOCUMENTS

| | | | | |
|---|---|---|---|---|
| 6,146,202 | A * | 11/2000 | Ramey et al. | 439/607.1 |
| 6,743,057 | B2 * | 6/2004 | Davis et al. | 439/701 |
| 7,182,642 | B2 * | 2/2007 | Ngo et al. | 439/607.35 |
| 7,416,447 | B1 * | 8/2008 | Chen | 439/607.05 |
| 7,497,736 | B2 * | 3/2009 | Minich et al. | 439/607.05 |
| 7,841,900 | B2 * | 11/2010 | Liu et al. | 439/607.07 |
| 8,083,553 | B2 * | 12/2011 | Manter et al. | 439/701 |
| 2001/0003685 | A1 * | 6/2001 | Aritani | 439/485 |
| 2001/0012729 | A1 * | 8/2001 | Van Woensel | 439/608 |
| 2002/0123266 | A1 * | 9/2002 | Ramey et al. | 439/608 |
| 2011/0189892 | A1 * | 8/2011 | Mizukami et al. | 439/607.34 |

FOREIGN PATENT DOCUMENTS

| | | |
|---|---|---|
| JP | 2007-502527 | 2/2007 |
| JP | 2011-60427 | 3/2011 |
| WO | WO 2005/004291 | 1/2005 |

* cited by examiner

*Primary Examiner* — Hae Moon Hyeon
(74) *Attorney, Agent, or Firm* — Staas & Halsey LLP

(57) ABSTRACT

A connector includes: a housing; and a connector module; the connector module including: a projection portion that projects outside from the housing; a substrate composed of a material with thermal conductivity; and a terminal that is fixed to a lower part of the substrate and contacts on an external substrate.

13 Claims, 10 Drawing Sheets

ELECTRICAL CONNECTOR WITH THERMAL CONDUCTIVE SUBSTRATE

CROSS-REFERENCE TO RELATED APPLICATION

This application is based upon and claims the benefit of priority of the prior Japanese Patent Application No. 2011-179528, filed on Aug. 19, 2011, the entire contents of which are incorporated herein by reference.

FIELD

A certain aspect of the embodiments discussed herein is related to a connector.

BACKGROUND

Conventionally, there has been known a connector that is welded to a contact pad on a printed circuit board by melting a solder by a reflow process (Japanese Laid-Open Patent Publication No. 2011-060427 and Japanese National Publication of International Patent Application No. 2007-502527). The reflow process is a process in which parts are mounted on the printed circuit board on which the solder has been printed, the printed circuit board is heated by the hot air of a heating device to melt the solder, and the parts and the printed circuit board are combined.

SUMMARY

According to an aspect of the present invention, there is provided a connector, including: a housing; and a connector module; the connector module including: a projection portion that projects outside from the housing; a substrate composed of a material with thermal conductivity; and a terminal that is fixed to a lower part of the substrate and contacts an external substrate.

The object and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A description will now be given of exemplary embodiments with reference to the accompanying drawings.

Figure 1:
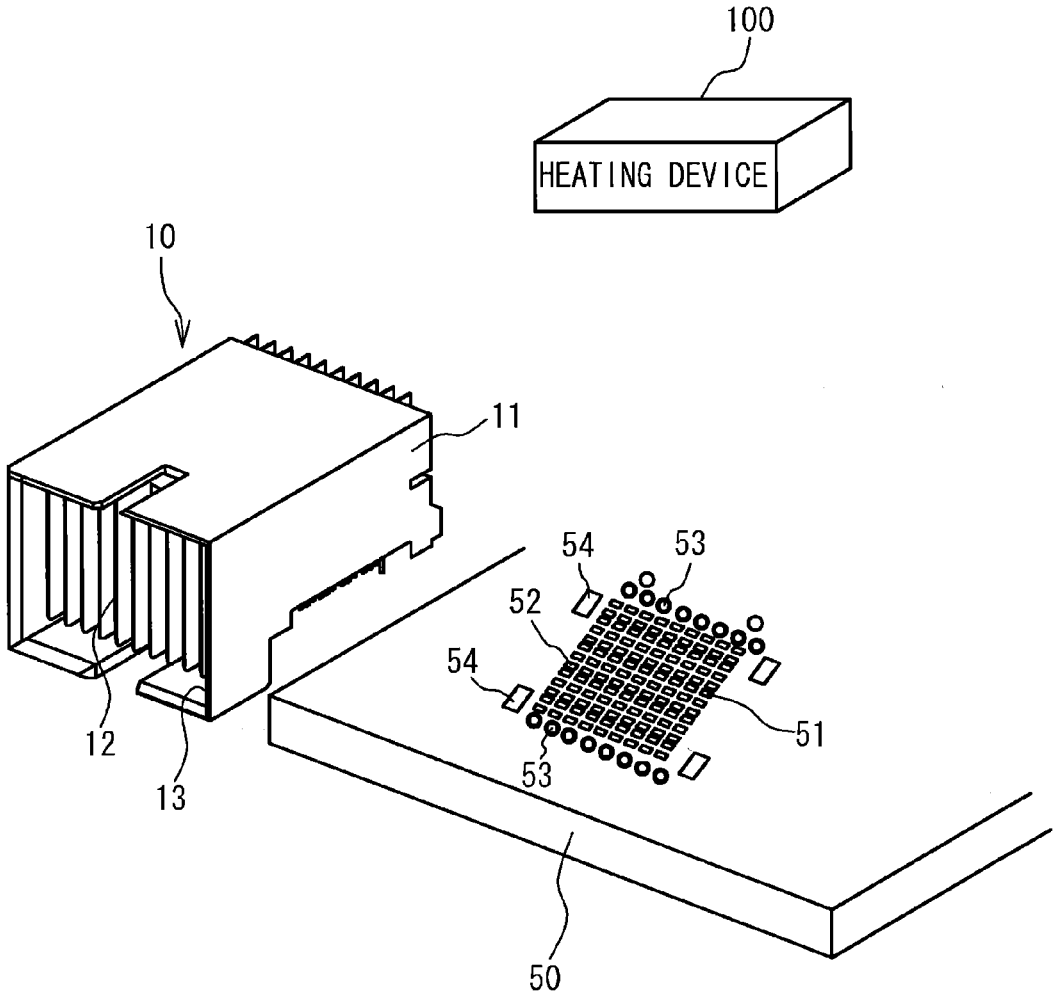
FIG. 1 is a diagram illustrating the schematic configuration of a connector 10 and a substrate 50 according to a first embodiment.
Figure 2A:
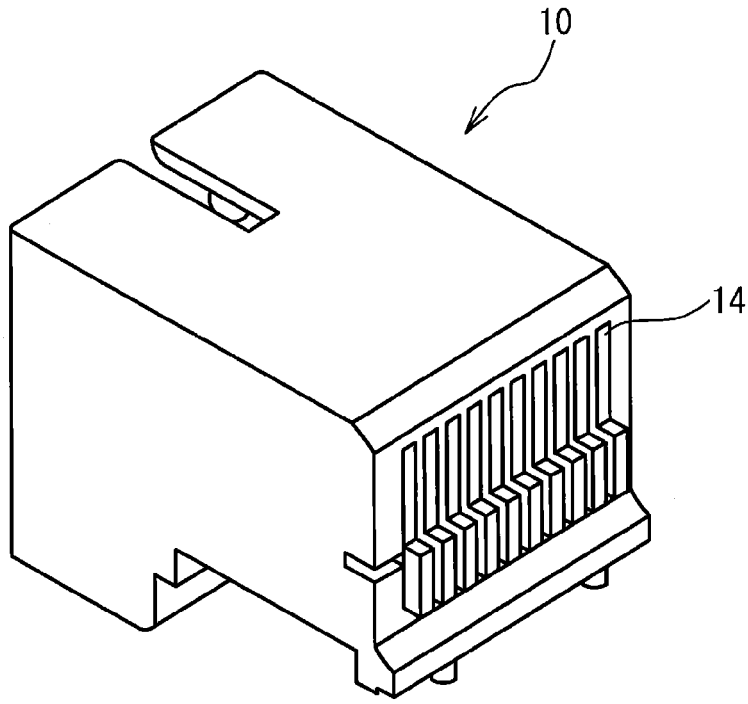
FIG. 2A is a perspective view illustrating the configuration of a back surface of the connector 10.
Figure 2B:
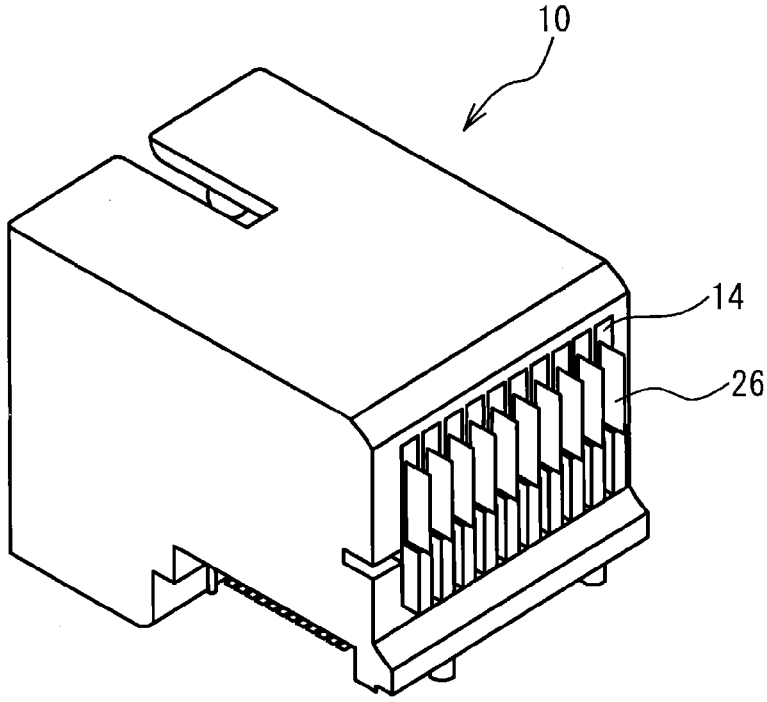
FIG. 2B is a perspective view illustrating the configuration of the back surface of the connector 10 when a plurality of connector modules 12 are incorporated into the connector 10.

FIG. 1 is a diagram illustrating the schematic configuration of a connector 10 and a substrate 50 according to a first embodiment. FIG. 2A is a perspective view illustrating the configuration of a back surface of the connector 10. FIG. 2B is a perspective view illustrating the configuration of the back surface of the connector 10 when a plurality of connector modules 12 are incorporated into the connector 10.

In FIG. 1, the connector 10 is mounted on a surface of the substrate 50, and is a high-density connector used for a computer, a personal computer, a work station, and so on. The connector 10 includes a housing 11 made of an insulator, and a plurality of connector modules 12 incorporated into the housing 11. Here, although the plurality of connector modules 12 are incorporated into the housing 11, it suffices that the connector 10 includes at least one connector module.

An opening 13 is formed on a front surface of the connector 10, and another connector, not shown, is attached to the connector modules 12 via the opening 13. Each of slits 14 for exposing outside a part of each connector module 12 (i.e., a projection unit 26 described later) is formed on the back surface of the connector 10, as illustrated in FIG. 2A. FIG. 2B illustrates a state where the part of each connector module 12 is exposed outside.

In FIG. 1, the substrate 50 as an external substrate is a rigid substrate such as a glass epoxy substrate. The substrate 50 includes: electrode pads 51; solder 52 applied on the electrode pads 51; holes 53 for fixing leg units 27 (see FIG. 3) extended in a vertical direction from the connector module 12; and concave units 54 for fixing the housing 11. By a reflow process, the hot air of a heating device 100 heats the substrate 50 to melt the solder 52, and hence the connector 10 is fixed on the substrate 50. In the reflow process, the heating device 100 sends the hot air to the connector 10 and the substrate 50 from an upper side of the connector 10 and the substrate 50.

Figure 3:
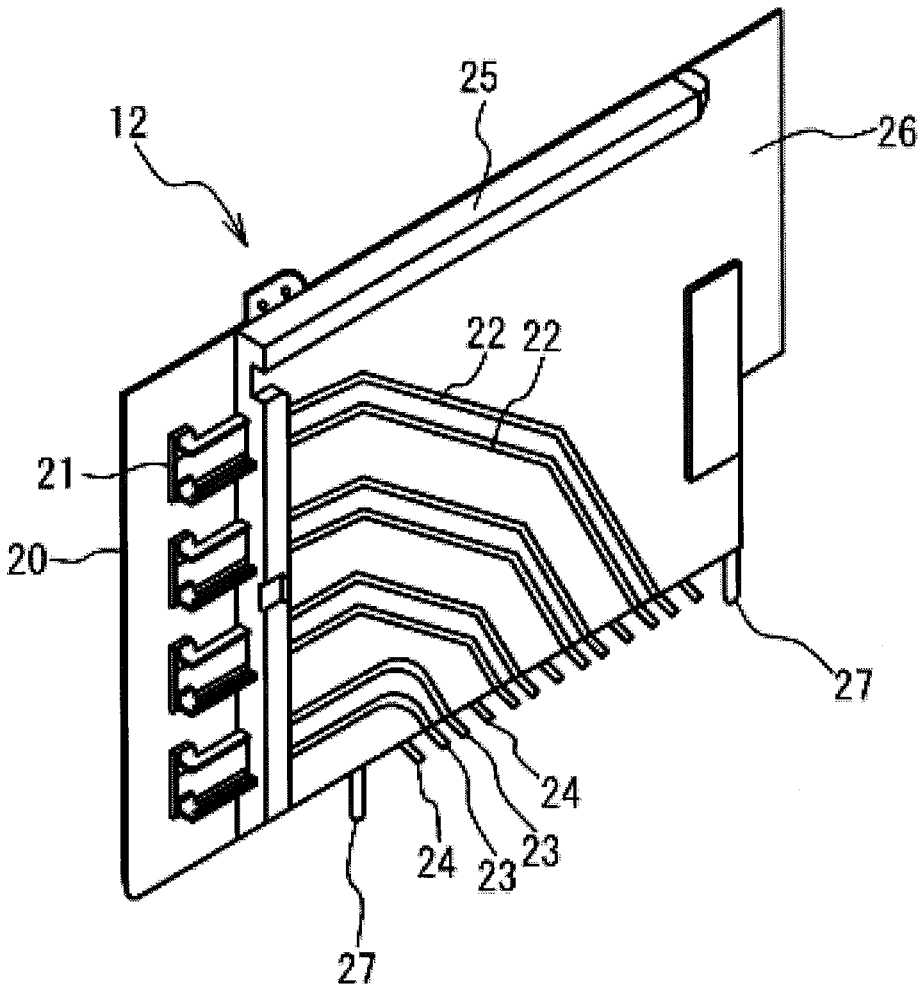
FIG. 3 is a diagram illustrating the configuration of one of the connector modules 12 included in the connector 10.
Figure 4:
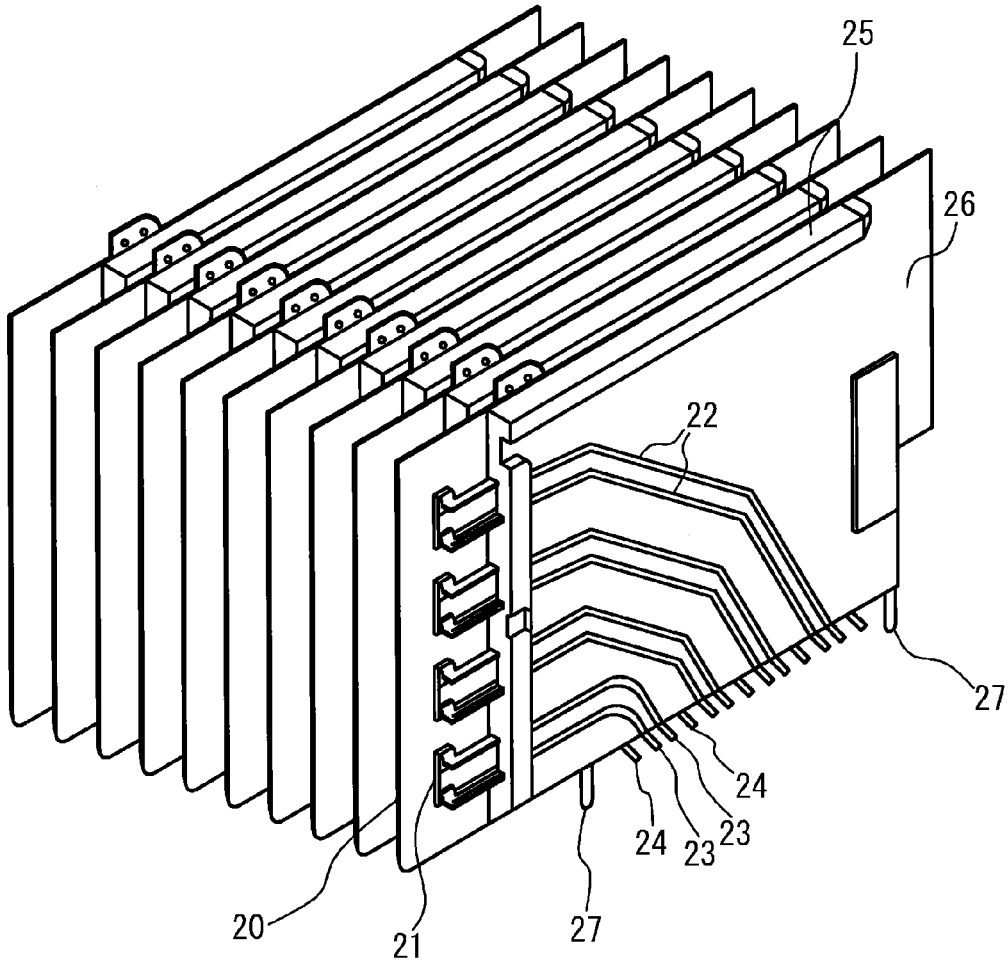
FIG. 4 is a diagram illustrating a set of connector modules 12.
Figure 5A:
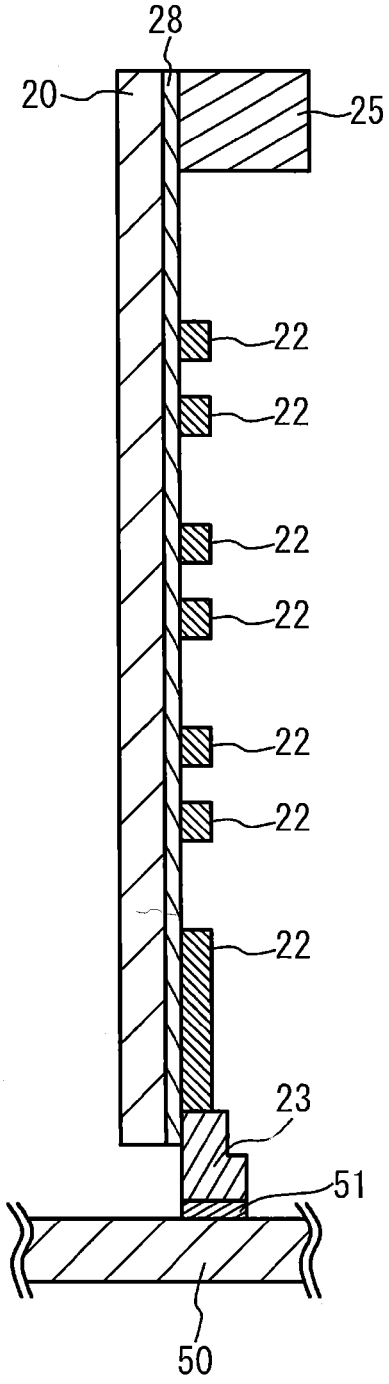
FIG. 5A is a cross-section diagram of the connector module 12 and the substrate 50 on a line passing a signal terminal 23.
Figure 5B:
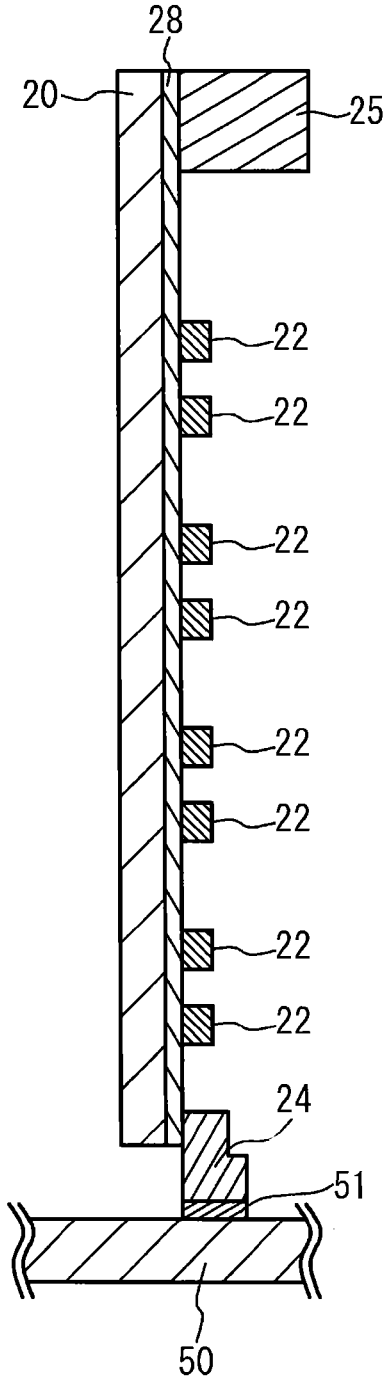
FIG. 5B is a cross-section diagram of the connector module 12 and the substrate 50 on a line passing a ground terminal 24.

FIG. 3 is a diagram illustrating the configuration of one of the connector modules 12 included in the connector 10. FIG. 4 is a diagram illustrating a set of connector modules 12. FIG. 5A is a cross-section, diagram of the connector module 12 and the substrate 50 on a line passing a signal terminal 23. FIG. 5B is a cross-section diagram of the connector module 12 and the substrate 50 on a line passing a ground terminal 24.

The connector module 12 includes a substrate 20, sockets 21, signal lines 22, and a frame 25, as illustrated in FIG. 3. The frame 25 is composed of resin made from a plastic, for example. The frame 25 is provided on an upper part of the substrate 20, and defines a distance between the connector modules 12, as illustrated in FIG. 4.

That is, the connector module 12 is separated from an adjacent connector module 12 by the thickness of the frame 25.

The substrate 20 is composed of a metal with high thermal conductivity, such as aluminum or copper, and an insulated film 28 is applied to the surface of the metal (see FIGS. 5A and 5B). The substrate 20 includes the projection unit 26 to be exposed outside from the back surface of the connector 10, as illustrated in FIG. 3.

The sockets 21 are connected to another connector to be connected to the connector 10. The connector module 12 includes four sockets 21, but the number of sockets 21 is not limited to this. Each socket 21 is connected to two signal terminals 23 via two signal lines 22. The two signal terminals 23 are fixed to a lower part of the substrate 20, and extend in a horizontal direction from the lower part of the substrate 20. A plurality of ground terminals 24 extend in the horizontal direction from the lower part of the substrate 20. The two signal terminals 23 are provided between a ground terminal 24 and an adjacent ground terminal 24. The signal terminals 23 and the ground terminals 24 are disposed on the electrode pads 51, and fixed on the electrode pads 51 by melting the solder 52.

In addition, the leg units 27 extend vertically downwards from the lower part of the substrate 20, and are inserted into the holes 53 on the substrate 50. Thereby, the motion in the horizontal direction of the connector module 12 is inhibited. Protrusions, not shown, which fit in the concave units 54, are formed on a bottom surface of the housing 11.

Figure 6:
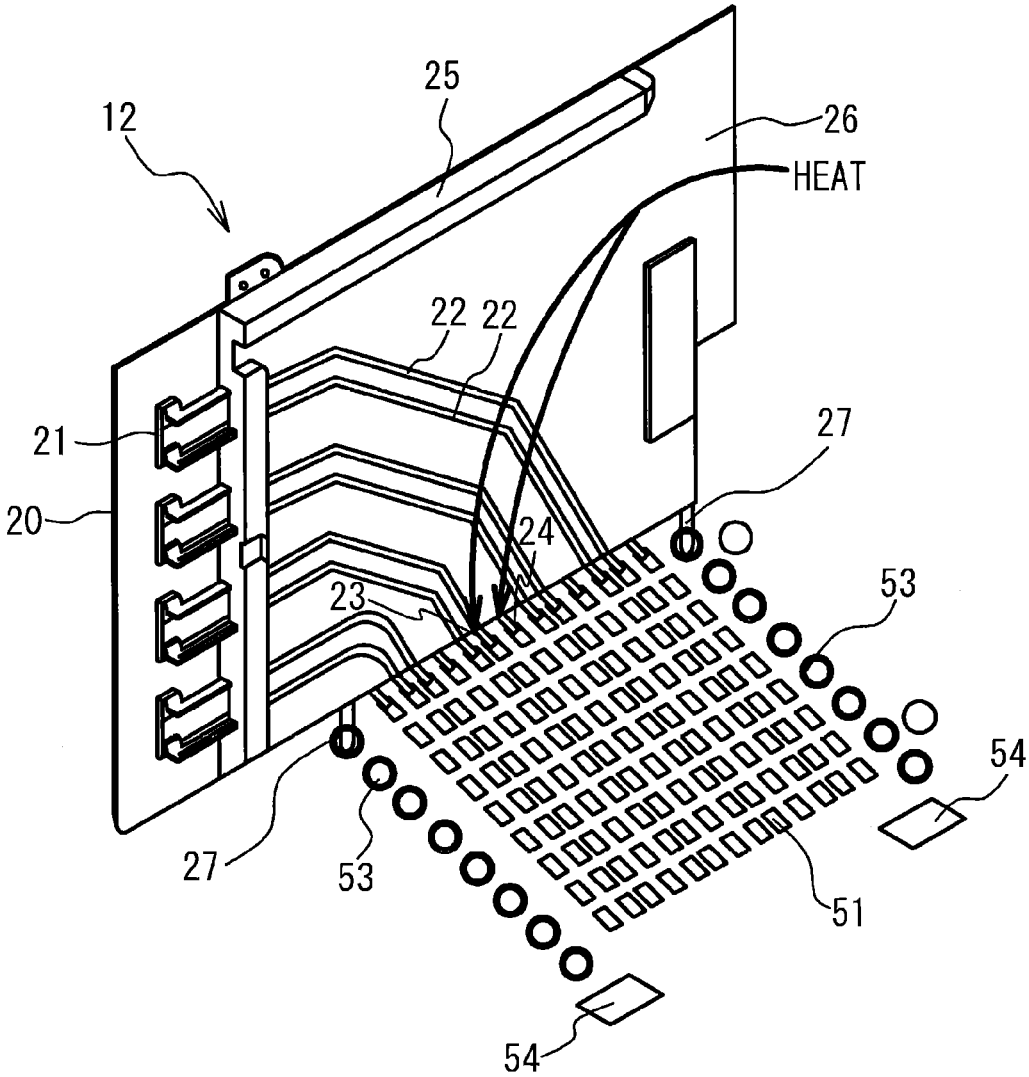
FIG. 6 is a diagram illustrating a state where heat is conducted to the signal terminal 23 and the ground terminal 24 from a projection unit 26.

The connector 10 constituted as mentioned above absorbs the heat of the heating device 100 from the projection unit 26 of the connector module 12, as illustrated in FIG. 6. The heat by the heating device 100 is conducted to the signal terminals 23 and the ground terminals 24 via the substrate 20. Thereby, the solder 52 on the electrode pads 51 in contact with the signal terminals 23 and the ground terminals 24 is melted easily.

When the connector 10 is used, the heat generated by the substrate 50 is conducted to the projection unit 26 of the connector module 12 via the signal terminals 23 and the ground terminals 24. Therefore, the projection unit 26 of the connector module 12 has a function as a heat sink emitting the heat generated by the substrate 50.

Figure 7A:
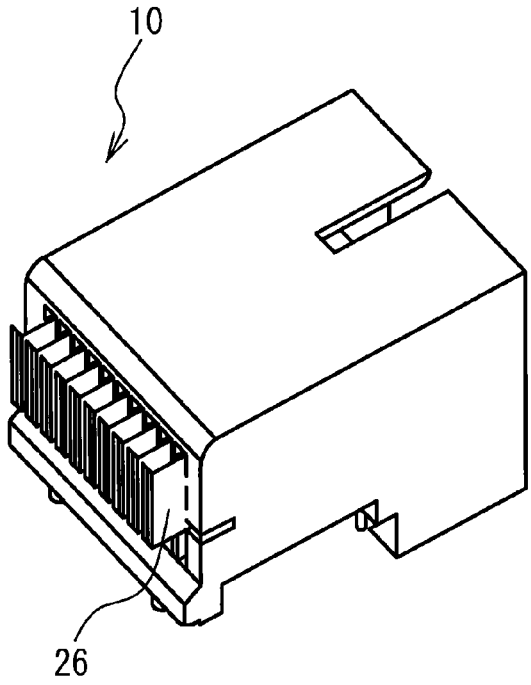
FIG. 7A is a perspective view illustrating the back surface of the connector 10.
Figure 7B:
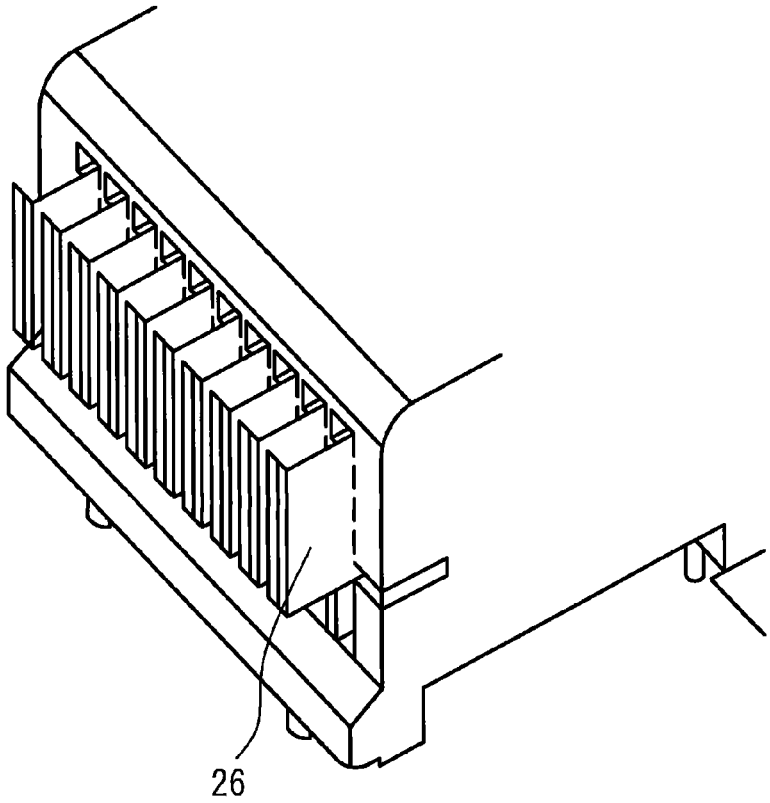
FIG. 7B is a diagram illustrating a first variation example of the projection unit 26 of the connector module 12.
Figure 8A:
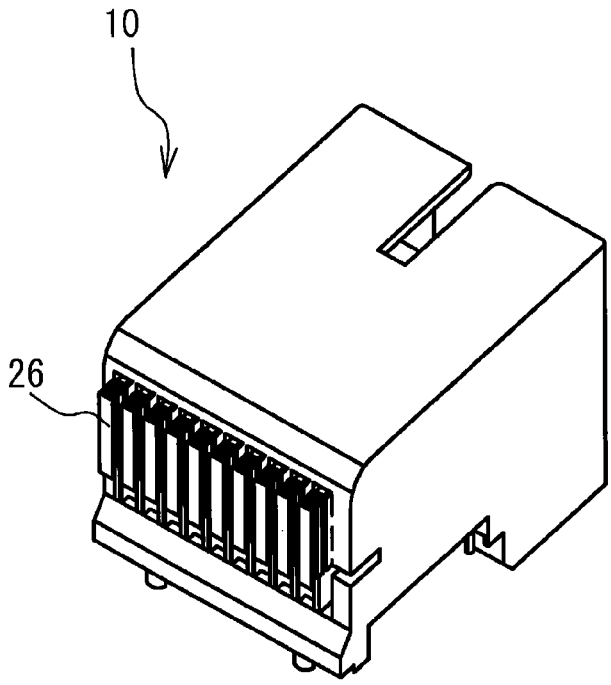
FIG. 8A is a perspective view illustrating the back surface of the connector 10.
Figure 8B:
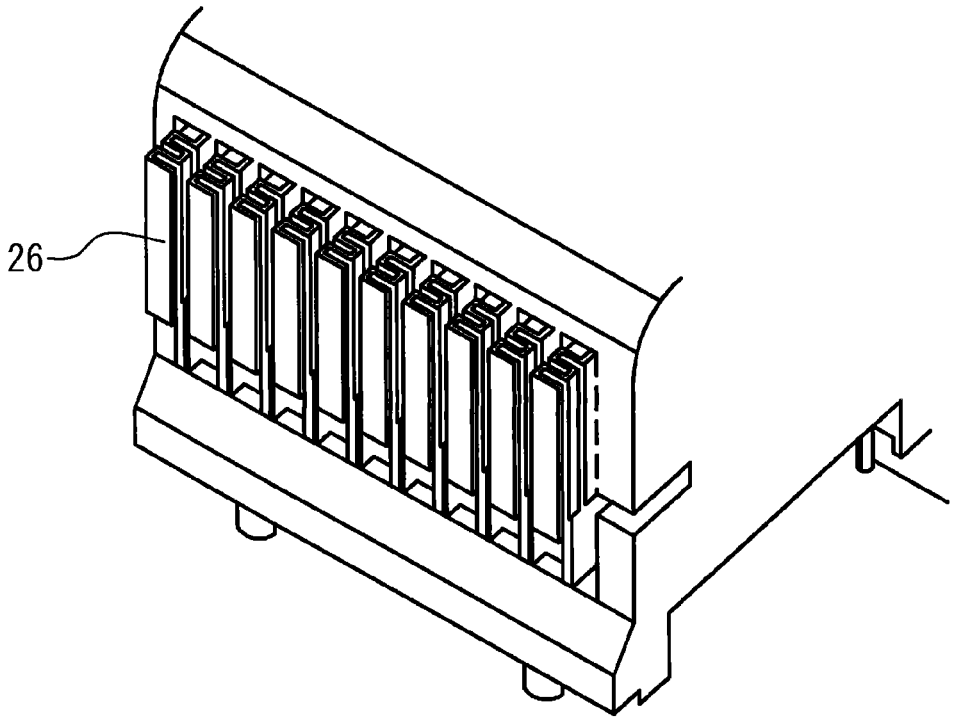
FIG. 8B is a diagram illustrating a second variation example of the projection unit 26 of the connector module 12.

FIG. 7A is a perspective view illustrating the back surface of the connector 10. FIG. 7B is a diagram illustrating a first variation example of the projection unit 26 of the connector module 12. FIG. 8A is a perspective view illustrating the back surface of the connector 10. FIG. 8B is a diagram illustrating a second variation example of the projection unit 26 of the connector module 12.

In FIG. 3, the projection unit 26 of the connector module 12 is a flat plate. However, as illustrated in FIG. 7B, the projection unit 26 of the connector module 12 may be bent in a direction of a side surface of the housing 11 of the connector 10 (i.e., bent in parallel with a side surface of the housing 11), for example. That is, the projection unit 26 of the connector module 12 may be bent in the shape of an "L" character, as viewed from above. Thereby, a direction and an area of a surface which easily receives the hot air can be increased. In addition, the projection unit 26 of the connector module 12 may be bent like a meandering shape, as illustrated in FIG. 8B. That is, the projection unit 26 of the connector module 12 may be bent two or more times in the direction of the side surface of the housing 11. Thereby, the surface area which absorbs the heat can be increased.

Figure 9:
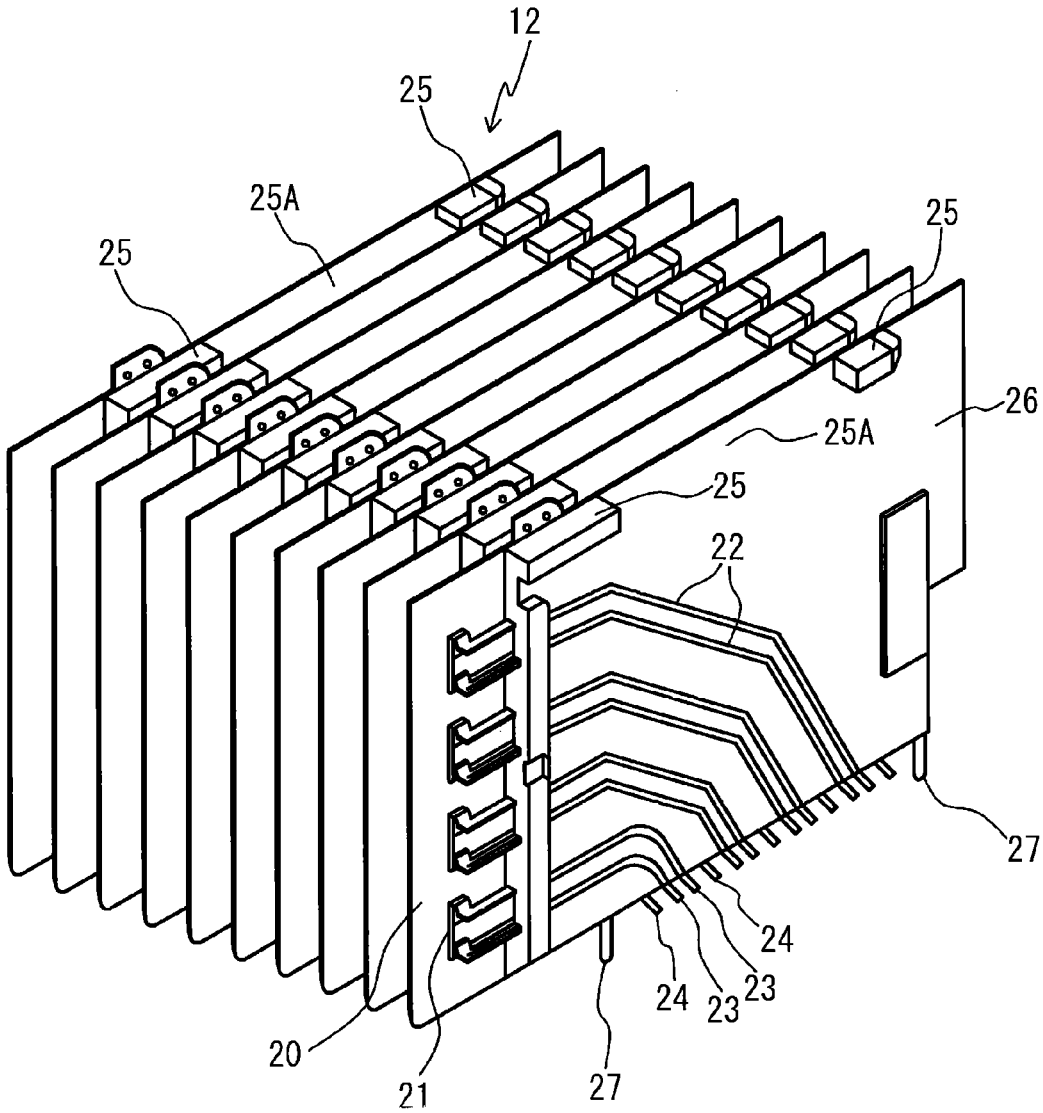
FIG. 9 is a diagram illustrating a variation example of the connector module 12.
Figure 10A:
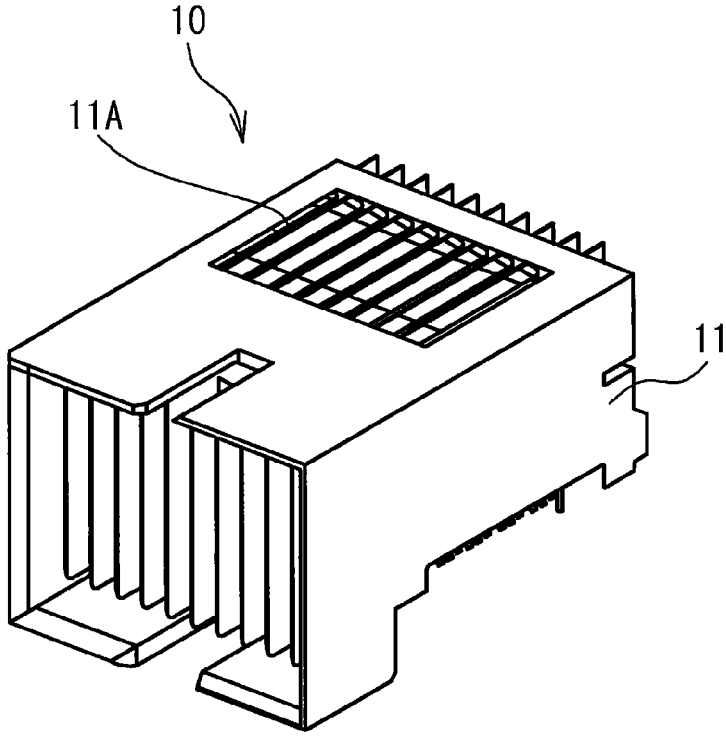
FIGS. 10A and 10B are diagrams illustrating variation examples of a housing 11 of the connector 10.
Figure 10B:
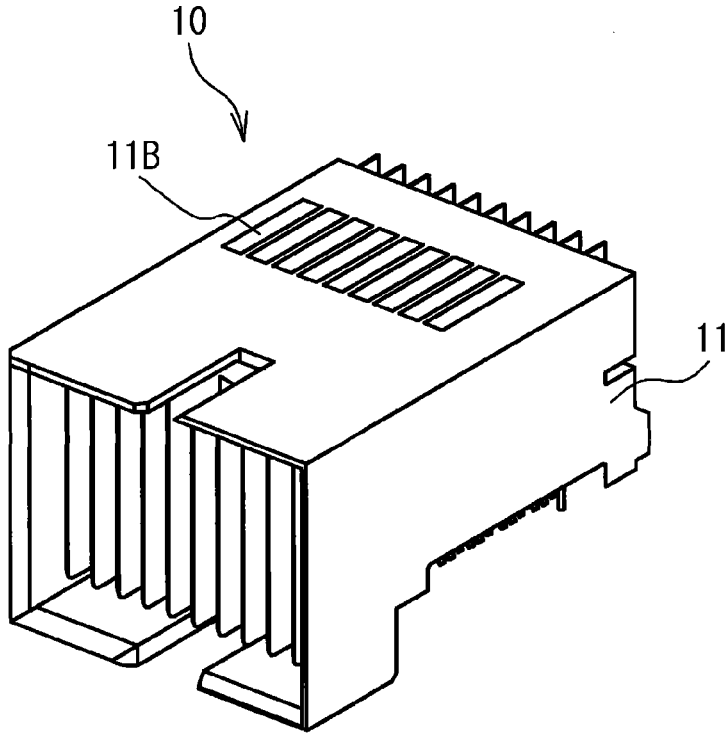

FIG. 9 is a diagram illustrating a variation example of the connector module 12. FIGS. 10A and 10B are diagrams illustrating variation examples of the housing 11 of the connector 10.

An opening unit 25A (a first opening portion) is formed at a position on the frame 25 opposed to the signal terminals 23 and the ground terminals 24, as illustrated in FIG. 9. An opening unit 11A is formed on a top surface of the housing 11, as illustrated in FIG. 10A. Alternatively, slits 11B may be formed on the top surface of the housing 11, as illustrated in FIG. 10B. Each of the opening unit 11A and the slits 11B functions as a second opening portion, and is formed to oppose to the opening unit 25A.

By forming the opening unit 25A and any one of the opening unit 11A and the slits 11B, a user can check the states of each signal terminal 23 and each ground terminal 24. That is, the user can check whether each signal terminal 23 and each ground terminal 24 are fixed on the electrode pads 51 by melting the solder 52. In addition, the hot air of the heating device 100 reaches the solder 52 easily by forming the opening unit 25A and any one of the opening unit HA and the slits 11B.

As described above, the heat absorbed in the projection unit 26 is conducted to the substrate 50 via the substrate 20, the signal terminals 23 and the ground terminals 24, and hence it is possible to easily melt the solder 52 on the substrate 50.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A connector to be mounted on a second, substantially planar substrate, the connector comprising:

a housing having a first side wall, and a second bottom wall to be opposed to the second substrate; and at least one connector module including a first, substantially planar, thermally conductive substrate having a main body received by the housing and a projection portion extending from the main body and out of the first side wall of the housing, and at least one thermally conductive terminal on the first substrate extending through the second bottom wall of the housing to contact the second, substantially planar substrate, wherein the first substrate is substantially perpendicular to the second substrate, and wherein a first end of the at least one terminal is arranged on a pad of the second substrate and is soldered on the pad, and the first end of the at least one terminal has a front edge and has a front edge substantially parallel to the second substrate.

2. The connector according to claim 1, wherein an end of the projection portion is bent perpendicular to the plane of the first substrate.

3. The connector according to claim 1, wherein an end of the projection portion is in an undulating shape.

4. The connector according to claim 1, wherein the at least one connector module is a plurality of connector modules, and a frame is provided on the first substrates of the plurality of the connector modules and defines spaces between the plurality of connector modules, and wherein a first opening portion is formed by the spaces to expose the at least one terminal, and a second opening is formed in the housing opposed to the first opening portion.

5. The connector according to claim 4, wherein each first substrate has a lower portion and an upper portion, the frame is provided at at least the upper portion, and the at least one terminal is provided at at least the lower portion.

6. The connector as recited in claim 1, wherein the at least one terminal includes a plurality of pairs of signal terminals.

7. The connector as recited in claim 6, further comprising a plurality of pairs of signal lines connected at one end thereof to the plurality of pairs of signal terminals.

8. The connector as recited in claim 7, wherein each pair of signal terminals is provided between a pair of ground terminals also provided on the first substrate.

9. The connector as recited in claim 8, wherein each of the ground terminals is connected to the second substrate via solder.

10. The connector as recited in claim 8, wherein the second substrate includes a plurality of electrode pads, each corresponding to one of the signal lines or one of the ground lines.

11. The connector as recited in claim 10, wherein a second opposite end of the at least one terminal is connected to a socket located on the first substrate.

12. The connector as recited in claim 1, wherein the first substrate includes a plurality of legs extending co-planar therefrom, and the second substrate includes a corresponding plurality of holes to receive the legs therein.

13. The connector as recited in claim 4, wherein the second opening portion is a plurality of slits formed in the housing.

* * * * *

UNITED STATES PATENT AND TRADEMARK OFFICE

CERTIFICATE OF CORRECTION

PATENT NO. : 8,708,741 B2
APPLICATION NO. : 13/587483
DATED : April 29, 2014
INVENTOR(S) : Tanaka et al.

It is certified that error appears in the above-identified patent and that said Letters Patent is hereby corrected as shown below:

In the Claims

Column 4, Line 61, Claim 1, before "substantially" delete "and has a front edge".

Signed and Sealed this
Twenty-ninth Day of July, 2014

Michelle K. Lee

Michelle K. Lee
*Deputy Director of the United States Patent and Trademark Office*